United States Patent [19]

Runck

[11] 4,402,888

[45] Sep. 6, 1983

[54] CORONA DISCHARGE TREATMENT ROLL

[75] Inventor: Walter A. Runck, Holmdel, N.J.

[73] Assignee: Pamarco Incorporated, Roselle, N.J.

[21] Appl. No.: 302,059

[22] Filed: Sep. 14, 1981

[51] Int. Cl.[3] ..... B21B 27/00

[52] U.S. Cl. ..... 264/22; 29/132; 425/174.4

[58] Field of Search ..... 29/132; 425/174.4; 427/40; 264/22

[56] References Cited

U.S. PATENT DOCUMENTS 2,881,470 4/1959 Berthold et al. ..... 264/22 X 3,639,639 2/1972 McCard ..... 24/132 X

OTHER PUBLICATIONS

Rosenthal, L. A., "Corona Discharge Electrode Concepts in Film Surface Treatment", Union Carbide Corp.

R-4-3117 Conformal Coating Brochure, Dow Corning Corp.

UVE-1006 Epoxy Coating, General Electric Co. form IMF-9A (50M).

Loctite AA Weld Sealant & 290 Brochure, Loctite Corp. 1976.

*Primary Examiner*—Eugene F. Desmond

*Attorney, Agent, or Firm*—Mark T. Basseches; Paula T. Basseches

[57] ABSTRACT

The present invention relates to improvements in treatment rolls for the corona discharge treatment of polymeric films whereby the same are rendered receptive to printing inks and the like. More particularly, the invention is directed to a treatment roll and method for use as an electrode in a corona discharge device, the roll being comprised of a metal substrate having a porous ceramic coating, the interstices in said coating being filled with silicone polymer, the roll evincing a high resistance to wear and electrical breakdown, whereby higher volumes of material may be processed.

4 Claims, 3 Drawing Figures

CORONA DISCHARGE TREATMENT ROLL

BACKGROUND OF THE INVENTION

1. Field of the Invention

The present invention is in the field of corona treatment devices and is directed more particularly to an mproved treatment roll to be used as the electrode, and nore particularly the ground electrode, in apparatus for :he treatment of polymeric films.

2. The Prior Art

It is known that polymeric materials such as polyethylene films which are initially non-receptive to inks may ɔe rendered printable by subjecting the same to corona lischarge. By way of example, procedures and apparatus for the treatment of films by corona discharge are lescribed in U.S. Pat. Nos. 2,802,085—Rothacker, Aug. 5, 1957; 2,859,480—Berthold et al, Nov. 11, 1958; 2,881,470—Berthold et al, Apr. 14, 1959; 3,397,136 Baiogh, Aug. 13, 1968, as well as in an article entitled Guide to Corona Film Treatment appearing in the May 1961 issue of Modern Plastics.

In general, corona treatment involves passing a film :o be treated through a corona discharge in an air gap ɔetween an electrode and a grounded roller supporting the film. Typically the roller is comprised of a metal substrate covered by a dielectric coating and the electrode, which may be of any form, is spaced a predetermined distance from the surface of the dielectric, the electrode being of a width or transverse extent generally coextensive with the width of the film being processed.

Conventional treater rolls have employed as the dielectric materials elastomeric or polymeric coatings, such a silicone rubber, hypalon, epoxy, etc. A further type of treater roll has employed a glass layer as the dielectric coating for the grounded metal substrate.

Although polymer dielectric coated treater rollers are relatively inexpensive, they are subject to rapid wear and frequent breakdown. The breakdowns, which may take various forms, are occasioned by a plurality of factors including the reaction of the rubber material to the ozone generated in the course of the treatment; the tendency of the rubber dielectric to develop pinholes, with resultant spark-through or arcing, and the deterioration and degradation of the rubber as a result of the heat generated as an adjunct to the treatment process.

The utilization of glass covered treater rolls has provided improved wear characteristics and resistance to spark-through but such rolls have other inherent drawbacks which militate against their widespread use. More particularly, the rollers have an extremely high initial cost and are fragile. Additionally, since the coefficient of thermal expansion of glass differs substantially from that of the metallic substrate, a glass coated roll must be operated within a relatively limited temperature range since the thickness of the coating must remain relatively small. Such limitations mandate that the power dissipation of the treatment apparatus be limited and, thus, the through-put of a treatment device utilizing a glass coated treatment roll must be retained at a relatively low level.

Adding to the expense of the glass covered roller is the fact that the rollers surfaces must be extremely smooth such that there is no air gap intervening between the film to be treated and the surface of the dielectric since, if such gap existed, a further corona would be developed in the gap and the reverse surface of the film would also be treated in that area or those areas coincident with the gap. Such surfaces are difficult to form in a glass coated roll.

Adding to the deficiencies of known prior art rolls is the current trend toward restricting the use of organic solvent based inks to avoid pollution. Whereas solvent based inks can be printed on polymeric films which have been treated in low power corona fields, the water based inks now favored require a deep or high density corona discharge to render the film suitably receptive.

SUMMARY

The present invention may be summarized as directed to an improved treater roll for use in the corona treatment of polymeric films, such as polyethylene films, and to a treatment method employing such roll.

More particularly, the present invention is directed to a treater roll which comprises a metallic cylindrical substrate supported on an axially directed shaft for rotation, the substrate functioning as an electrode, and particularly the ground electrode, in a corona treatment procedure.

The invention is characterized by the dielectric coating of the roll being comprised of a porous ceramic material, and particularly a thin layer of such material applied by a plasma or flame spray method. The pores or interstices of the plasma deposited ceramic are filled preferably with a silicone, epoxy, or acrylic polymer having high dielectric strength. The ceramic material is comprised of a refractory oxide, and particularly aluminum oxide ($Al_2O_3$). The material is applied such as to evince a porosity of from about 5% to about 15%—that is to say, the volume of voids is approximately 5% to 15% of the total volume of the ceramic coating.

A treatment roll in accordance with the invention is extremely durable, highly resistant to electrical breakdown and is extremely effective in dissipating heat, whereby the corona discharge apparatus may be operated at high power levels without over-heating, enabling the film to be drawn through the discharge area at increased speeds and thus enabling a greater throughput.

Accordingly, it is an object of the invention to provide an improved treatment roll for the processing of polymeric films or the like by corona discharge methods.

A further object of the invention is the provision of a method of corona treatment wherein there is employed as the treatment roll component a cylindrical roll having a metallic substrate, the dielectric components whereof are formed by a porous ceramic layer of a thickness preferably in the range from about 0.02" to about 0.05" or more, the pores or interstices of which layer are filled with a polymer having high dielectric constant and resistant to heat. The porous ceramic layer is formed by plasma spray method, the porosity of the layer being controlled within desired limits, preferably by the use of refractory metal oxide particles within a selected size range. The resultant roller, after the porous layer is filled with polymer, evinces high wear resistance characteristics, effective heat dissipation, resistance to damage as a result of thermal expansion, and resistance to electrical breakdown or arcing.

To attain these objects and such further objects as may appear herein or be hereinafter pointed out, reference is made to the accompanying drawings, forming a part hereof, in which.

Figure 1:
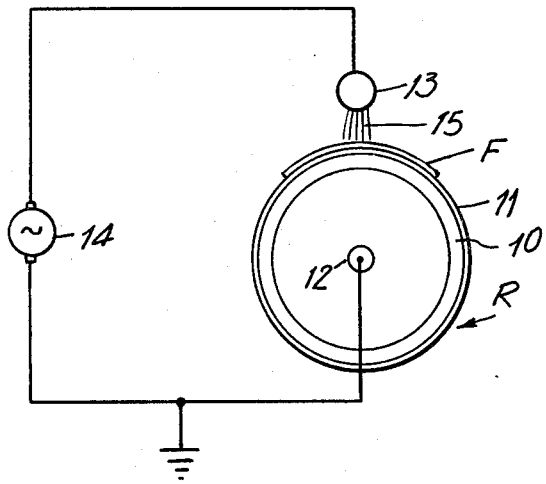
FIG. 1 is a diagrammatic or schematic view of a corona treatment apparatus.

Referring now to the drawings, and particularly to FIG. 1, there is disclosed a treatment apparatus including a cylindrical metal roller R having a substrate 10, the outer surface of which carries a dielectric coating or layer 11. The roller R is mounted by means of shaft 12 so as to be rotatable, preferably about a horizontal axis. As is known, the roll is preferably hollow such as to permit circulation of a cooling air stream therethrough. The substrate 10 forms a ground electrode of an electrical circuit.

A treatment electrode, illustratively 13, electrically isolated from ground, is spaced a predetermined, preferably adjustable distance from the surface of the dielectric 11.

The element 14 represents diagrammatically a known electrical high frequency-high voltage generator or circuit calculated to produce in the gap between the electrode 13 and the dielectric coating 11 a corona discharge 15.

As is known, a polymeric film F which is drawn through the gap so as to be exposed to the corona discharge will have its corona-adjacent surface portion treated by exposure to the corona so as to render the same receptive to printing inks, coatings and adhesives.

Since the corona discharge treatment method, the parameters of spacing of the electrode elements, the characteristics of the electrical circuits and various modes for advancing the polymeric film through the corona so as to treat a surface or surfaces are known per se and thus form no part of the present invention, a detailed description thereof will not be undertaken.

The essence of the present invention resides in the nature and composition of the dielectric layer 11.

More particularly, it has been discovered that by forming the dielectric layer 11 of a flame or plasma spray applied coating of refractory oxide and particularly aluminum oxide, which coating is porous in nature, and by filling the noted coating with a polymer or polymers, there is provided a corona treatment roller having exceptionally desirable characteristics.

Whereas heretofore in the construction of treatment rolls the art had attempted to make the dielectric coatings as dense and impermeable as possible to prevent the possibility of spark-through, it has unexpectedly been discovered to be highly advantageous to provide an initial relatively porous dielectric coating and to fill the same with polymer. The resultant dielectric surfaces have proven to be demonstrably superior to either a ceramic coating or to a polymer coating per se.

Without limitation and in order to comply with the requirements of the patent law, there is noted below a specific procedure for the formation of the coating, it being understood by those skilled in the art that numerous variations may suggest themselves to those familiarized with the instant disclosure, and that the invention is not to be taken as limited by the ensuing description except as embodied in the claims.

The metal roll to be covered, illustratively a steel roll, is first chemically degreased and thereafter, in order to provide an adherent base, is grit blasted with a relatively coarse aluminum oxide powder. Generally a 36 to 46 grit aluminum oxide is employed at pressures ranging from about 60 to 100 psi. The prepared roller is then flame sprayed utilizing conventional flame spray equipment, illustrative examples of suitable spray equipment being hereinafter identified.

The material applied is a refractory metal oxide and preferably high purity aluminum oxide powder cuts having average particle sizes in the range of from about 25 to 45 microns, and preferably cuts between 30 and 40 microns. Suitable alumina powders are available from several commercial sources including Metco, Inc. of Westbury, Long Island, being identified by such organization by the trade designation METCO 105. The material has a typical composition of 98.5% pure aluminum oxide, 1% silicon dioxide, with the balance being comprised of other oxides.

The material is applied by a conventional flame or plasma spray coating apparatus so as to achieve an even coat, preferably in the range of from about 0.02" to about 0.05" or slightly thicker, which coat evinces a porosity of about 5 to 15% voids.

Suitable flame spray application devices are manufactured by Metco, Inc., and satisfactory coatings have been obtained utilizing spray guns of the type identified by such organization as 3MB and 7MB, nozzle type GH. However, virtually any flame spray coating apparatus may be successfully employed.

In accordance with a typical procedure, a roll is coated while the same is rotated at a surface speed of approximately 240 feet per minute, the spray gun being advanced axially along the roll during coating at a rate of approximately 6 to 8 revolutions of the roll per inch of traverse of the spray gun. The spray nozzle is spaced in the range of from about 2 to 4" from the surface of the roll and the refractory material is applied at a rate of about 5½ pounds per hour. An application efficiency in the neighborhood of about 75% is observed.

As will be recognized by those skilled in the art, the various parameters may be changed in accordance with the desired coating thickness, etc.

Similarly, due allowance should be made for the desired thickness of the dielectric coat, with thicker coats being indicated where heavy duty, high voltage treatments will be encountered.

When the desired coating build-up is achieved (about 0.02" to about 0.05" being a preferred range with applications up to 0.100" having been successfully tested, the roller is belt sanded or ground to a smooth finish so as to minimize the possiblity of spaces developing between the roller surface and a polymeric film to be treated. The ground or sanded roller is thereafter sealed with a polymeric material in liquid form. A suitable silicone polymer material is available from Dow Corning and is identified by the trade designation R-4-3117. The material as supplied includes a 75% non-volatile content by weight, has a specific gravity at 25° C. of 1.07, and a viscosity at such temperature of 800 centipoises. This mixture is preferably further diluted to contain about 45% solids by weight.

The material is applied in any suitable manner, as by a brush, a roller or vacuum impregnation. Excess material is wiped from the surface. A further light coating of the material may be applied by spraying. However, the principal effect of such coating is merely to improve the appearance and smoothness of the finished roller. The roller is thereafter subjected to air cure.

Numerous alternative silicone formulations have been satisfactorily employed and, accordingly, the specific silicone resinous formulation is not critical to the satisfactory operation of the roller.

By way of example, the described silicone material has a dielectric strength, dry, of 1300 volts per mil and a thermal conductivity of $2.9\times10^{-4}$ cal/sec/cm$^2$/cm/°C.

As an alternate impregnating material, epoxy compositions have been satisfactorily employed. As an example of such epoxy, reference is made to a material manufactured and distributed by the General Electric Corporation of Schenectady, N.Y. under the trade designation UVE-1003 Epoxy. This material is a 100% solids content, solventless, ultra violet light curable material. The material has a viscosity (Brookfield) at 25° C. of 700 c.p.s. Brookfield RBT, #2 spindle 10 rpm, dielectric strength at 60 Hz, 25° C. 650 V/mil. The material is applied as noted above and is cured through the use of a medium pressure mercury vapor lamp rated at from 200 to 300 watts per lineal inch.

A further satisfactory impregnating material having a dimethylacrylate base is available from Loctite Corporation of Newington, Conn. under the trade designation Loctite 290. This material comprises a low viscosity anaerobic curing polymer which cures by polymerization into a thermoset plastic. The material has good wicking properties and a viscosity at 68° F. from 10 to 15 c.p.s. The material is applied as above and curing is effected by isolating the impregnated roller from the atmosphere.

It is anticipated that numerous other polymeric materials may be found having the necessary characteristics for successful impregnation, such characteristics including high dielectric strength and resistance to melting or decomposition at elevated temperatures.

Figure 3:
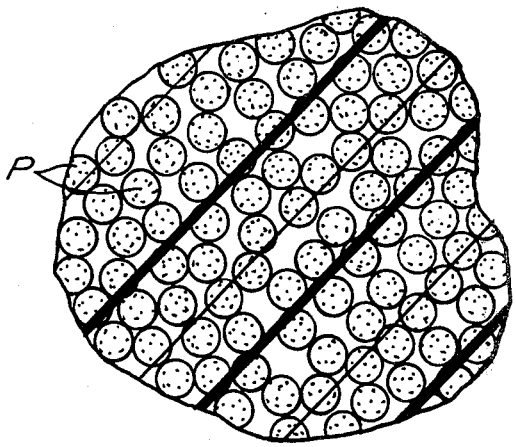
FIG. 3 is a greatly magnified cross-sectional view through an increment of the dielectric coating of the treatment apparatus.
Figure 2:
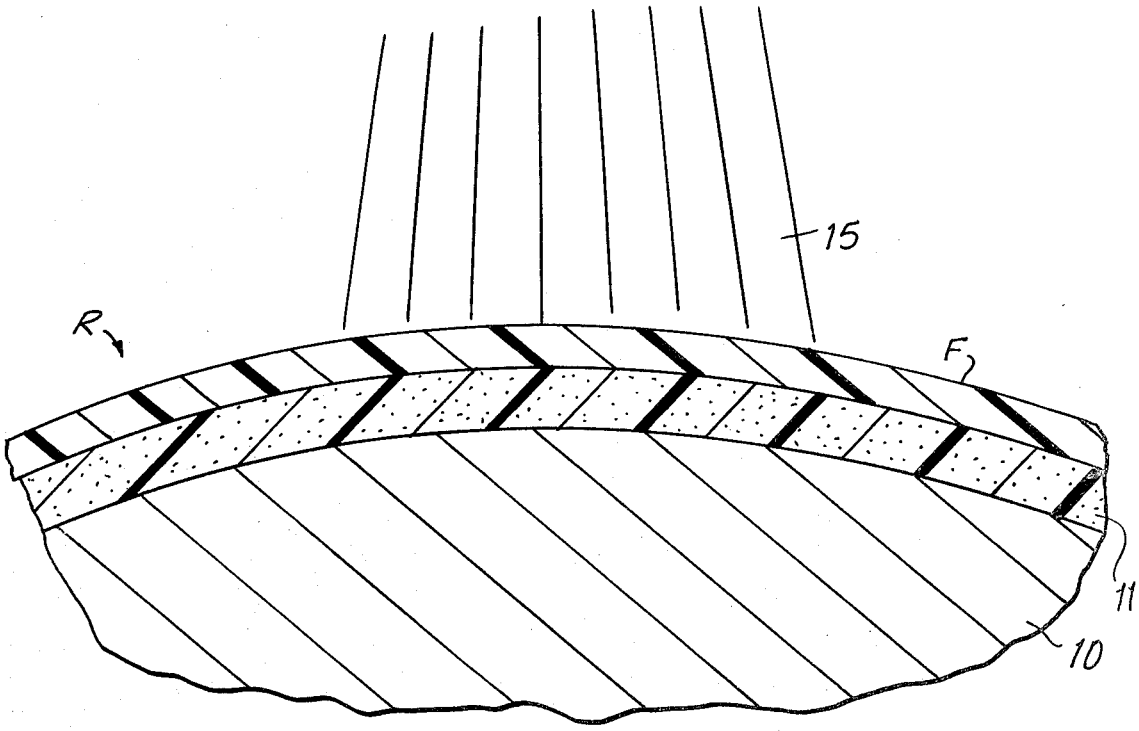
FIG. 2 is a magnified fragmentary view, likewise diagrammatic, of portions of the treatment roller.

Referring to FIG. 3, a much magnified diagrammatic sectional view of an increment of the applied coating, the refractory particles are indicated by reference numeral P, the pores or spaces between particles being essentially completely filled with polymer.

Without limitation to any specific theory, it is believed that the special effectiveness of a treatment roll formed in accordance with the above disclosure is engendered by the unique properties of the filled ceramic coating which include high thermal conductivity, high dielectric strength and resistance to localized electrical breakdown, an ability to expand and contract (sponginess) without the formation of cracks and without the tendency of the coating to separate from the metal substrate under varying thermal conditions.

The superior characteristics of the treatment roll enable the corona discharge apparatus to operate at higher power levels without breakdown, with the result that films may be advanced through the unit at greater speeds to increase through-put, or, if operated at conventional speeds, to achieve a greater treatment depth, providing a printable surface of non-organic solvent inks.

Normally the art, in constructing a dielectric coated treatment roll, would regard it as desirable to form the dielectric layer with minimum porosity. Unexpectedly, however, it has been discovered that application of the refractory powder to form a dense and less porous layer results in inferior performance. More particularly, a coating within the 0.02" to 0.05" thickness range was formed on a roll through the use of aluminum oxides of substantially smaller particle size than noted above. The coating which, due to the fine particle size, evinced a porosity of only about 3%, was treated with silicone in the manner above described. The resultant roll evinced markedly inferior characteristics as a corona treatment roll, exhibiting increased spark-through and overheating tendencies, albeit the same performed in a superior manner to certain conventional treatment rolls.

As hereinabove stated, numerous variations in specific aspects of the manufacture of the roll may be made without departing from the spirit of the invention. The characteristics thought to be essential to the production of a corona treatment roll having the desired properties are embodied in the appended claims and, accordingly, the same should be broadly construed.

Having thus described the invention and illustrated its use, what is claimed as new and is desired to be secured by Letters Patent is:

1. The process of rendering a polymeric film receptive to surface printing which comprises the steps of continuously advancing said polymeric film in the gap defined between a treater roll having a conductive metallic substrate and an electrode disposed in spaced parallel relation to said roll while maintaining between said substrate and said electrode an alternating current potential sufficient to create a corona discharge in said gap, characterized in that said roll includes a substantially even dielectric coating of a thickness in the range of from about 0.02" to about 0.05" or more comprised of porous refractory oxides having a density in the range of from about 85 to 95%, the pores within said oxide coating being substantially completely filled with polymeric material having high dielectric strength.

2. The process in accordance with claim 1 wherein said refractory oxide comprises aluminum oxide.

3. The process in accordance with claim 2 wherein said oxide coating is applied by a thermal spray operation.

4. The process in accordance with claim 3 wherein said oxide coating is effected using aluminum oxide powder cuts having average particle sizes in the range of from about 25 to 45 microns.

* * * * *